US005941097A

United States Patent [19]

Higginbotham et al.

[11] Patent Number: 5,941,097

[45] Date of Patent: Aug. 24, 1999

[54] METHOD AND APPARATUS FOR SEPARATING AIR TO PRODUCE AN OXYGEN PRODUCT

[75] Inventors: Paul Higginbotham, Guildford, United Kingdom; Joseph P. Naumovitz, Lebanon, N.J.

[73] Assignee: The BOC Group plc, Windlesham, United Kingdom

[21] Appl. No.: 09/044,405

[22] Filed: Mar. 19, 1998

[51] Int. Cl.[6] ..... F25J 3/00

[52] U.S. Cl. ..... 62/646; 62/652

[58] Field of Search ..... 62/646, 652

[56] References Cited

U.S. PATENT DOCUMENTS

| | | | |
|---|---|---|---|
| 5,379,599 | 1/1995 | Mostello | 62/646 |
| 5,386,692 | 2/1995 | Laforce | 62/646 |
| 5,469,710 | 11/1995 | Howard et al. | 62/646 |

*Primary Examiner*—Ronald Capossela

*Attorney, Agent, or Firm*—David M. Rosenblum; Salvatore P. Pace

[57] ABSTRACT

A method and apparatus for separating air to produce an oxygen product in which air is separated within a double column arrangement. In the double column arrangement part of the air to be separated reboils a lower pressure column and is then introduced into the higher pressure column for separation. Another part of the air is partially cooled and then expanded with the performance of work and then introduced into the lower pressure column to supply part of the refrigeration requirements. The remaining part of the refrigeration requirements is supplied by partially vaporizing a crude liquid oxygen stream within a head condenser used to produce reflux for the higher and lower pressure columns. The partially vaporized stream is then phase separated into liquid and vapor phases. The liquid phase is introduced into the lower pressure column and the vapor stream after having been partially warmed is turboexpanded to provide the remaining refrigeration requirements of the plant.

8 Claims, 1 Drawing Sheet

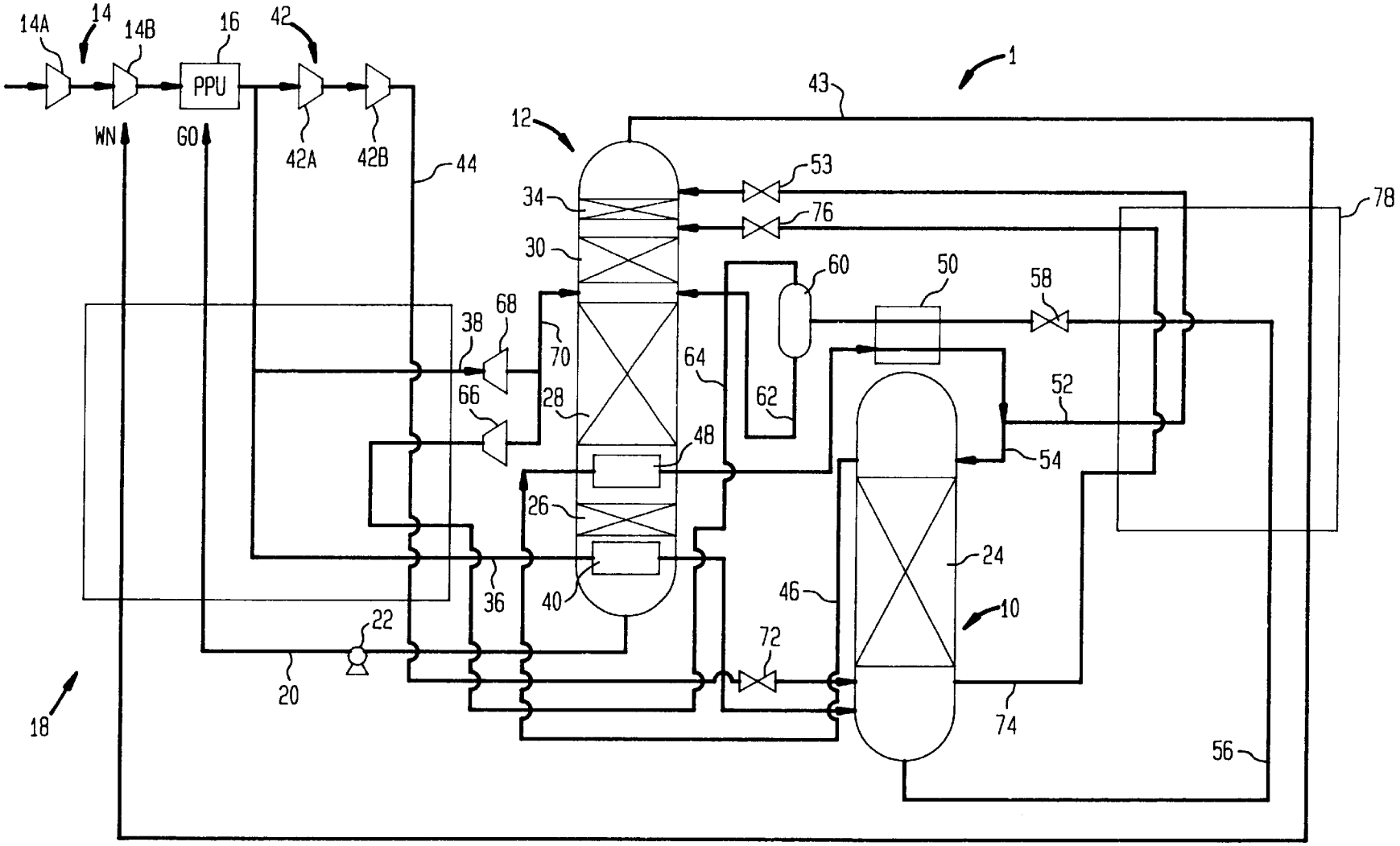
FIG.

METHOD AND APPARATUS FOR SEPARATING AIR TO PRODUCE AN OXYGEN PRODUCT

BACKGROUND OF THE INVENTION

The present invention relates to a method and apparatus for separating air to produce an oxygen product in which the air is separated in a double distillation column system having a higher pressure column and a lower pressure column reboiled at multiple levels thereof. More particularly, the present invention relates to such a method and apparatus in which part of the plant refrigeration requirements are produced by partially vaporizing crude liquid oxygen withdrawn from the bottom of the higher pressure column and expanding the resultant vapor.

There are many plant designs that can be employed for separating air by cryogenic rectification to produce an oxygen product. In one type of plant design, the air is initially separated in a higher pressure column to produce an oxygen enriched liquid column bottoms and a nitrogen rich tower overhead. The oxygen rich liquid column bottoms is further refined in a lower pressure column to produce a liquid oxygen column bottoms and a nitrogen vapor tower overhead. The liquid oxygen column bottoms is formed into a product stream that may be taken as a liquid and then either vaporized or pumped to a vaporization pressure against liquefaction of a boosted pressure air stream.

The lower pressure column is reboiled at several levels. The bottom level reboiling is effectuated by condensing at least part of the air to be separated. After such partial condensation, the air is introduced into the higher pressure column for separation. Nitrogen rich tower overhead of the higher pressure column is condensed in a head condenser and then used to reflux both the higher and lower pressure columns. Such condensation is effectuated by valve expanding a crude liquid oxygen steam, composed of the oxygen enriched liquid column bottoms of the higher pressure column, to form a coolant for the head condenser. The coolant is then used to fully condense nitrogen rich vapor taken from the higher pressure column.

It is known that the energy outlay involved in running such a plant is dependent upon the degree to which the air condenses within the lower reboiler located in the lower pressure column. The lower the degree of condensation, the lower the degree to which the incoming air must be compressed by the main air compressor. It has been found by the inventors herein, further energy savings can be realized that are obtainable in the prior art.

SUMMARY OF THE INVENTION

The present invention provides a method of separating air to produce an oxygen product. In accordance with the method, the air is separated in a double distillation column arrangement having higher and lower pressure columns. Nitrogen rich tower overhead and an oxygen enriched liquid column bottoms is produced in the higher pressure column. A liquid oxygen column bottoms and a nitrogen vapor tower overhead is produced within the lower pressure column. The lower pressure column is reboiled at multiple levels. The lowermost level is reboiled with a first part of the air to be separated.

A crude liquid oxygen stream composed of the oxygen enriched liquid column bottoms is withdrawn from the higher pressure column and is valve expanded and partially vaporized through indirect heat exchange with at least part of a nitrogen rich tower overhead stream composed of the nitrogen rich tower overhead. The partially vaporized crude liquid oxygen stream is phase separated into vapor and liquid components, rich in nitrogen and oxygen, respectfully. A liquid stream composed of the liquid component is introduced into the lower pressure column and a vapor stream composed of the vapor stream is partially warmed. A refrigerant stream is introduced into the lower pressure column that is formed by expanding with the performance of work a second part of the air to be separated and the vapor stream after having been partially warmed. A product stream composed of the oxygen product is withdrawn from the lower pressure column.

In another aspect, the present invention provides an apparatus for separating air to produce an oxygen product. In accordance with the apparatus, a double distillation column arrangement is provided to separate the air. The arrangement has higher and lower pressure columns to produce in the higher pressure column, a nitrogen rich tower overhead and an oxygen enriched liquid column bottoms. A liquid oxygen column bottoms and a nitrogen vapor tower overhead is produced in the lower pressure column. The lower pressure column is provided with a bottom reboiler located within a bottom region thereof to reboil the liquid oxygen column bottoms and an intermediate reboiler located to produce intermediate reboil at an intermediate location of the lower pressure column. The higher pressure column has a head condenser to condense a nitrogen rich stream composed of the nitrogen rich tower head and to partially vaporize a crude liquid oxygen stream composed of the oxygen enriched liquid column bottoms. This produces reflux from the nitrogen rich stream for both the higher and lower pressure columns.

A main air compressor compresses the air and a purification unit purifies the air. A main heat exchanger is in communication with the purification unit and is provided with passages configured to fully cool a first subsidiary air stream, to partially cool a second subsidiary air stream, to partially warm the vapor stream and to fully warm and vaporize a product stream. The main heat exchanger is connected to the double column distillation unit so that the first subsidiary air stream is introduced into the bottom reboiler and at least partially condenses. The bottom reboiler is connected to the higher pressure column so the first partial stream after passage through the bottom reboiler is introduced into the higher pressure.

The head condenser is in communication with the intermediate reboiler and the intermediate reboiler is in communication with the lower pressure column so that the nitrogen rich stream passes from the higher pressure column to the intermediate reboiler and partially condenses and thereafter passes through the head condenser and fully condenses. The head condenser is also connected to the higher and lower pressure columns so that reflux stream made up of the nitrogen rich stream after having been fully condensed passed to the higher and lower pressure columns as reflux. A first expansion valve is interposed between the higher pressure column and the head condenser to expand the crude liquid oxygen stream to a temperature suitable for the partial condensation of the nitrogen rich stream. A phase separator is connected to the head condenser to separate liquid and vapor phases of the coolant stream after the partial vaporization thereof. The phase separator is connected to the lower pressure column so that a liquid stream composed of the liquid phase is introduced into the lower pressure column for further refinement thereof. The phase separator is also connected to the main heat exchanger so that the vapor stream composed of the vapor phase partially warms. Two expansion machines are connected to the heat exchanger for expanding with the performance of work the vapor stream and the second subsidiary air stream. The two expansion machines are also connected to the lower pressure column so that the vapor and the second subsidiary air stream are introduced into the lower pressure column. The lower pressure column is connected to the main heat exchanger so that the product stream passes from the lower pressure column to the main heat exchanger and is made up of oxygen.

The energy savings of the present invention are realized through the use of a vapor stream composed of the vapor phase of the crude liquid oxygen stream to supply refrigeration. In a prior art, all refrigeration is produced by expanding an air stream which supplies air to the lower pressure column which must itself be separated. In the present invention, the utilization of the vapor stream that has been "preseparated" reduces usage of air for such purpose. As such, recovery of oxygen can been boosted without an increase in energy outlay or for a given oxygen production, less energy is used.

As used herein and in the claims, the term "fully cooled" means cooled to a temperature suitable for the rectification of air which would be normally at the cold end of the main heat exchanger. The term "fully warmed" means warmed to a temperature at or at least around ambient or a temperature at the warm end of the main heat exchanger. The terms "partially cooled" or "partially warmed" mean the cooling or warming of the stream to temperatures between ambient and distillation or the warm and cold ends of the main heat exchanger. A further point here is the terms higher and lower pressure columns do not denote a particular pressure for the higher of lower pressure columns but rather that one column operates at a higher pressure than the other column.

BRIEF DESCRIPTION OF THE DRAWINGS

While the specification concludes with claims distinctly pointing out the subject matter that Applicants' regard as their invention, it is believed that the invention will be better understood when taken in connection with the accompanying drawings in which the sole FIGURE is a schematic of an apparatus for carrying out a method in accordance with the present invention.

DETAILED DESCRIPTION

With reference to the FIGURE, an apparatus 1 for separating air to produce an oxygen product is illustrated. Apparatus 1 is provided with a double column arrangement comprising a higher pressure column 10 and a lower pressure column 12.

Air after having been filtered is compressed in a compressor unit 14 having multiple stages such as 14A and 14B. Carbon dioxide and heavy hydrocarbons and moisture are removed from the air within a know pre-purification unit 16 which can consist of beds of alumina operating out of phase having on-line conditions in which the purification is effected and then off-line conditions in which the beds are regenerated by known pressure swing adsorption processes or temperature swing adsorption processes.

The air is cooled within a main heat exchange unit 18 which can be several units that are connected together in a heat transfer relationship. Liquid oxygen product collects as a liquid oxygen column bottoms within the lower pressure column 12. A product stream 20 is then pumped to a delivery pressure by a pump 22 and then fully vaporized within the main heat exchange unit 18 to produce gaseous oxygen designated as "GO". Although not illustrated, an alternative embodiment would be to extract gaseous oxygen to form product stream 20. In such case, pump 22 would not be used.

Higher pressure column 10 produces an oxygen enriched liquid column bottoms and a nitrogen rich tower overhead. Mass transfer contacting elements 24 are located within higher pressure column 10 to effect the required mass transfer of liquid and vapor phases of the mixture to be separated. Lower pressure column 12, as stated previously, produces a liquid oxygen column bottoms and a nitrogen vapor tower overhead. Mass transfer elements 26, 28, 30 and 34 are provided such purpose. The foregoing mass transfer elements 24, 26, 28, and 34 can be either trays or packing. Packing can either be random or structured packing.

The air after having been compressed and purified is introduced into main heat exchanger 18 which has passages that are configured to produce a first subsidiary air stream 36 and a second subsidiary air stream 38. First subsidiary air stream is introduced into a bottom reboiler 40 located within lower pressure column 12. Preferably, first subsidiary air stream partially condenses and then is introduced into higher pressure column 10. As would be know to those skilled in the art, first subsidiary air stream 36 could be phase separated so that a liquid and vapor phases thereof would be introduced into lower pressure column 12 and higher pressure column 10, respectively. Since product stream 20 is pumped, booster compressor unit 42 having stages 42A and 42B is provided to produce a third subsidiary air stream 44. Depending upon the required pressure of the product, booster compressors 42 can act to produce third subsidiary air stream 44 in a supercritical state.

The waste nitrogen stream composed of nitrogen vapor tower overhead is removed from lower pressure column 12 and expelled from main heat exchange unit 18 as a waste nitrogen stream 43, designated "WN". Reflux for both the higher and lower pressure columns is produced by withdrawing a nitrogen rich stream 46 composed of the nitrogen rich tower overhead within higher pressure column 10. Nitrogen rich stream 46 is then partially condensed within an intermediate reboiler 48 located at an intermediate level of lower pressure distillation column 12. Nitrogen rich stream 46 after such partial condensation is passed into a head condenser 50 where condensation is completed to produce reflux streams 52 and 54 which are introduced into both the higher and lower pressure columns 10 and 12, thereby to initiate formation of a descending liquid phase of the mixtures to be separated within higher and lower pressure columns 12. An expansion valve 53 reduces pressure of reflux stream 52 to that of lower pressure column 12. An alternative embodiment to the foregoing might be to separate nitrogen rich stream 45 into two partial streams after withdrawal from higher pressure column 10 and then fully condensing one of the two partial streams in intermediate reboiler 48 and fully condensing the other of the two partial streams in head condenser 50.

Coolant for head condenser 50 is provided by withdrawing a crude liquid oxygen stream 56 and valve expanding such stream within a first expansion valve 58. Crude liquid oxygen stream 56 partially vaporized within head condenser 50. Disengagement of the liquid and vapor phases of the thus partially vaporized crude liquid oxygen stream 56 is effectuated within a phase separator 60. Liquid stream 62, composed of the liquid phase, is introduced into the lower pressure column 12 and a vapor stream 84, composed of the vapor phase, is partially warmed within a passageway designed for such purpose within main heat exchanger 18. Vapor stream 64 and second subsidiary air stream 38 are expanded within expansion machines which are preferably turboexpanders 66 and 68. The exhaust streams of turboexpander 66 and 68 are then combined to form a refrigerant stream 70 which is introduced into lower pressure column 12.

The illustrated embodiment can be designed so that roughly 45% of the refrigeration requirements are provided are provided by expansion of vapor stream 64. In any plant, the actual split will of course depend on product requirements and the design and efficiency of the various components used within the plant.

Third subsidiary air stream 44, after having been fully cooled and after being reduced in pressure by a valve 72, is introduced into higher pressure column 10. Such valve expansion produces liquid and vapor phases of the mixture. The bottom region of higher pressure column 10 is used as a phase separator to produce a high pressure column liquid stream 74 which is valve expanded via a valve 76 to lower pressure column pressure and is then introduced into lower pressure column 12. High pressure column liquid stream 74 is preferably subcooled along with crude liquid oxygen stream 56 and reflux stream 54 within a subcooling unit 78. The subcooling is effectuated by countercurrent passage of waste nitrogen stream 43.

While the present invention has been described with reference to a preferred embodiment, as will occur to those skilled in the art, numerous changes, additions and omissions may be made without departing from the spirit and scope of the present invention.

We claim:

1. A method of separating air to produce an oxygen product comprising:

separating the air in a double distillation column arrangement having higher and lower pressure columns, thereby to produce in the higher pressure column, a nitrogen rich tower overhead and an oxygen enriched liquid column bottoms and in the lower pressure column, a liquid oxygen column bottoms and a nitrogen vapor tower overhead;

reboiling the lower pressure column at multiple levels, the lowermost level being reboiled with a first part of the air to be separated;

withdrawing from the higher pressure column a crude liquid oxygen stream composed of said oxygen enriched liquid column bottoms, valve expanding said crude liquid oxygen stream, and partially vaporizing said crude liquid oxygen stream through indirect heat exchange with at least part of a nitrogen rich tower overhead stream composed of the nitrogen rich tower overhead;

phase separating said crude liquid oxygen stream into vapor and liquid components rich in nitrogen and oxygen, respectively;

introducing a liquid stream composed of the liquid component into the lower pressure column;

partially warming a vapor stream composed of the vapor phase;

introducing a refrigerant stream into the lower pressure column formed by expanding with the performance of work, a second part of the air to be separated and said vapor stream after having been partially warmed; and withdrawing a product stream composed of the oxygen product from the lower pressure column.

2. The method of claim 1, wherein:

said lower pressure column is reboiled an intermediate level with said nitrogen rich tower overhead stream, thereby partially condensing said nitrogen rich tower overhead stream; and said nitrogen rich tower overhead stream is fully condensed through said indirect heat exchange with said crude liquid oxygen stream.

3. The method of claim 1, wherein:

said product stream is composed of said liquid oxygen column bottoms;

prior to separating said air, compressing and purifying the air;

fully cooling a first subsidiary air stream formed from the air, thereby to form said first part of the air;

partially cooling a second subsidiary air stream also formed from the air, thereby to form said second part of the air;

further compressing a third subsidiary air stream formed from the air;

pumping said product stream to a delivery pressure;

fully cooling a waste nitrogen stream withdrawn from said low pressure column;

passing said product stream and said waste nitrogen stream in indirect heat exchange with said first, second and third subsidiary air streams to fully and partially cool said first and second subsidiary air streams, respectively, and to liquefy said third subsidiary air stream; and valve expanding said third subsidiary air stream and introducing said third subsidiary air stream into said higher pressure column.

4. The method of claim 1, wherein the work of expansion is applied to the further compression of said second subsidiary air stream.

5. The method of claim 1, wherein:

said third subsidiary stream is further compressed so that said third subsidiary stream is a supercritical fluid and is valve expanded prior to its introduction into said higher pressure column to produce liquid and vapor; and the liquid as a higher pressure column air stream is introduced into the lower pressure column.

6. An apparatus for separating air to produce an oxygen product, said method comprising:

a double distillation column arrangement to separate said air, said double distillation column unit having higher and lower pressure columns to produce in the higher pressure column a nitrogen rich tower overhead and oxygen enriched liquid column bottoms and in the lower pressure column, a liquid oxygen column bottoms and a nitrogen vapor tower overhead;

the lower pressure column having a bottom reboiler located within a bottom region thereof to reboil said liquid oxygen column bottoms and an intermediate reboiler located to produce intermediate reboil at an intermediate location of the lower pressure column;

the higher pressure column having a head condenser to condense a nitrogen rich stream composed of the nitrogen rich tower overhead and to partially vaporize a crude liquid oxygen stream composed of the oxygen enriched liquid column bottoms, thereby to produce reflux from the nitrogen rich stream for both the higher and lower pressure columns;

a main air compressor to compress the air;

a purification unit to purify the air;

a main heat exchanger in communication with said purification unit and having passages configured to fully cool a first subsidiary air stream, to partially cool a second subsidiary air stream, to partially warm a vapor stream and to fully warm (and vaporize) a product stream;

the main heat exchanger connected to the double column distillation unit so that said first subsidiary air stream is introduced into said bottom reboiler and at least partially condenses;

the bottom reboiler connected to the higher pressure column so that said first partial stream after passage through said bottom reboiler is introduced into said higher pressure column;

the head condenser in communication with the intermediate reboiler and the intermediate reboiler in communication with said higher pressure column so that said nitrogen rich stream passes from the higher pressure column to said intermediate reboiler and partially condenses and thereafter passes through said head condenser and fully condenses;

the head condenser also connected to said higher and lower pressure columns so that reflux streams made up of said nitrogen rich stream after having been fully condensed pass to said higher and lower pressure columns as reflux and said coolant stream is received therewithin;

a first expansion valve interposed between said higher pressure column and said head condenser to expand said crude liquid oxygen stream to a temperature suitable for the partial condensation of the nitrogen rich stream;

a phase separator connected to the head condenser to separate liquid and vapor phases of the coolant stream after the partial vaporization thereof;

the phase separator connected to the lower pressure column so that a liquid stream composed of the liquid phase is introduced into the lower pressure column for further refinement thereof and also connected to the main heat exchanger so that said vapor stream composed of the vapor phase partially warms;

two expansion machines connected to the main heat exchanger for expanding with the performance of work said vapor stream and said second subsidiary air stream;

the two expansion machines also connected to the lower pressure column so that said vapor stream and said second partial stream are introduced into the lower pressure column; and the lower pressure column connected to the main heat exchanger so that said product stream passes from the said lower pressure column to the main heat exchanger and is made up of oxygen.

7. The method of claim 6, further comprising:

the lower pressure column being connected to the main heat exchanger so that said product stream is made up of said liquid oxygen column bottoms;

a pump to pump said product stream; and a booster compressor to compress a third subsidiary air stream composed of the air;

a main heat exchanger connected to said lower pressure column to fully warm a waste nitrogen stream and to fully cool said third subsidiary air stream;

the main heat exchanger also connected to said higher pressure column so that said third subsidiary air stream is introduced therein;

a second expansion valve interposed between said main heat exchanger and said higher pressure column to valve expand said third subsidiary air stream;

said higher and lower pressure columns are also connected so that a higher pressure column stream formed from introduction of said second subsidiary air stream into said higher pressure column is introduced into said lower pressure column;

a third expansion valve interposed between said higher and lower pressure columns to valve expand said higher pressure column stream; and a subcooler unit to subcool said higher pressure column air stream, said another nitrogen-rich liquid stream, and said crude liquid oxygen stream through indirect heat exchange with said waste nitrogen stream.

8. The apparatus of claim 6, wherein said first and second expansion machines are connected to said booster compressor to recover part of the work of expansion.

* * * * *